US006685495B1

(12) United States Patent
Ko

(10) Patent No.: US 6,685,495 B1
(45) Date of Patent: Feb. 3, 2004

(54) MICRO COAXIAL CABLE END CONNECTOR ASSEMBLY

(75) Inventor: David Tso-Chin Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/313,242

(22) Filed: Dec. 5, 2002

(51) Int. Cl.[7] ..... H01R 13/627
(52) U.S. Cl. ..... 439/353; 439/497; 439/607
(58) Field of Search ..... 439/353, 350, 439/357, 358, 607, 610, 497, 579

(56) References Cited

U.S. PATENT DOCUMENTS 4,365,856 A * 12/1982 Yaegashi et al. ..... 439/497
4,993,968 A * 2/1991 Guletsky et al. ..... 439/492
5,085,596 A * 2/1992 Bowen et al. ..... 439/497
5,980,308 A * 11/1999 Hu et al. ..... 439/497
6,273,753 B1 * 8/2001 Ko ..... 439/579

* cited by examiner

*Primary Examiner*—Hien Vu
(74) *Attorney, Agent, or Firm*—Wei Te Chung

(57) ABSTRACT

A micro coaxial connector assembly (100) comprises an insulative housing (1), a contact set (2) assembled to a rear end of the housing and comprising an insulative insert (21), and a plurality of contacts (22), and a plurality of wires (3). The insulative insert defines a plurality of channels (211) and a plurality of passageways (210) respectively communicating with the channels. Each of the contacts comprises an engaging portion (221) extending through a corresponding passageway, and a connecting portion (222) received in a channel for soldering to an exposed end of a conductor (31) of a wire. Each channel has a soldering portion (2111), an obstructing portion (2112), and a retention portion (2113). The exposed end of the conductor is received in the soldering and obstructing portion. An insulation of the wire sheathing the conductor is received in the retention portion, whereby hot air applied to the soldering portion in order to solder the exposed end of the conductor and the connecting portion of the contact together is prevented from flowing into the retention portion to melt the insulation.

2 Claims, 6 Drawing Sheets

MICRO COAXIAL CABLE END CONNECTOR ASSEMBLY

CROSS-REFERENCE TO RELATED APPLICATION

This patent application is a co-pending application of U.S. patent application Ser. No. 10/199,713, entitled "MICRO COAXIAL CABLE CONNECTOR HAVING LATCHES FOR SECURELY ENGAGING WITH A COMPLEMENTARY CONNECTOR", filed on Jul. 19, 2002 and Ser. No. 10/246,259, entitled "MICRO COAXIAL CABEL CONNECTOR HAVING LATCHES FOR SECURELY ENGAGING WITH A COMPLEMENTARY CONNECTOR", filed on Sep. 17, 2002, both assigned to the same assignee as the present application.

BACKGROUND OF THE INVENTION

1. Field of the Invention

The present invention relates to a low profiled micro coaxial cable connector used in liquid crystal display (LCD) application, and particularly to such connector having an improved insert in which wires of the cable connector are received and soldered to contacts of the connector. The insert is so configured that hot air applied to solder the wires to the contacts is prevented from flowing to PVC insulations of the wires. Thus, melting of the PVC insulations by the hot air for soldering is avoided.

2. Description of Related Art

U.S. Pat. Nos. 6,305,978 B1, 6,273,753 B1, and 6,338,652 B1 disclose low profiled micro coaxial cable connectors. These cable connectors are used for transmitting signals between a mother board in a base of a notebook computer and an LCD panel of the notebook computer. A cable has a plurality of wires each being sheathed with an insulation made of PVC material. The wires must be securely soldered to a plurality of contacts of the cable connector to transmit signals in a reliable manner. However, during the soldering process, the hot air for soldering may cause the PVC insulation to melt. In the old design, the micro coaxial connector has no obstructing device to prevent the hot air for soldering from flowing into the place where the PVC insulation is located; thus, the PVC insulation may be melted by the hot air for soldering. To avoid this problem, in the prior art, the wires are one by one manually soldered to the contacts. Such a soldering process is laborious and expensive. It is desired to provide a new micro coaxial cable connector assembly having an improved insert; the insert has an obstructing portion to block hot air for soldering conductors of wires to contacts from flowing into a place receiving PVC insulations of the wires; thus, melting of the PVC insulations due to the hot air is prevented.

SUMMARY OF THE INVENTION

Accordingly, an object of the present invention is to provide a micro coaxial cable connector having an improved insulative insert for preventing hot air for soldering wires to contacts of the connector from flowing to heat insulations of the wires. Thus, melting of the insulations of the wires by the hot air for soldering is prevented.

In order to achieve the object set forth, an cable connector assembly comprises an elongate insulative housing, a contact set received in the housing, and a plurality of the wires inserted into the contact set.

The insulative housing comprises a base portion, a tongue portion extending from the base portion, and a plurality of passageways defined through the base portion and the tongue portion. The contact set is assembled to a rear end of the housing and comprises an insulative insert and a plurality of contacts, the insulative insert includes a plurality of channels, the contacts are received in the channels, the contacts extend into the passageways of the housing. The wires are connected to the contacts and received in the channels of the insulative insert; wherein each of the channels of insulative insert comprises a soldering portion, an obstructing portion in rear of the soldering portion, and a retention portion in rear of the obstructing portion. The obstructing portion is narrower than the soldering portion and the retention portion, and wherein each of the wires has a conductor and an insulation sheathing the conductor, a front exposed end of the conductor is received in corresponding obstructing and soldering portions and soldered to a portion of a corresponding contact in the corresponding soldering portion, and the insulation is received in a corresponding retention portion.

Other objects, advantages and novel features of the invention will become more apparent from the following detailed description when taken in conjunction with the accompanying drawings.

DETAILED DESCRIPTION OF THE INVENTION

Figure 1:
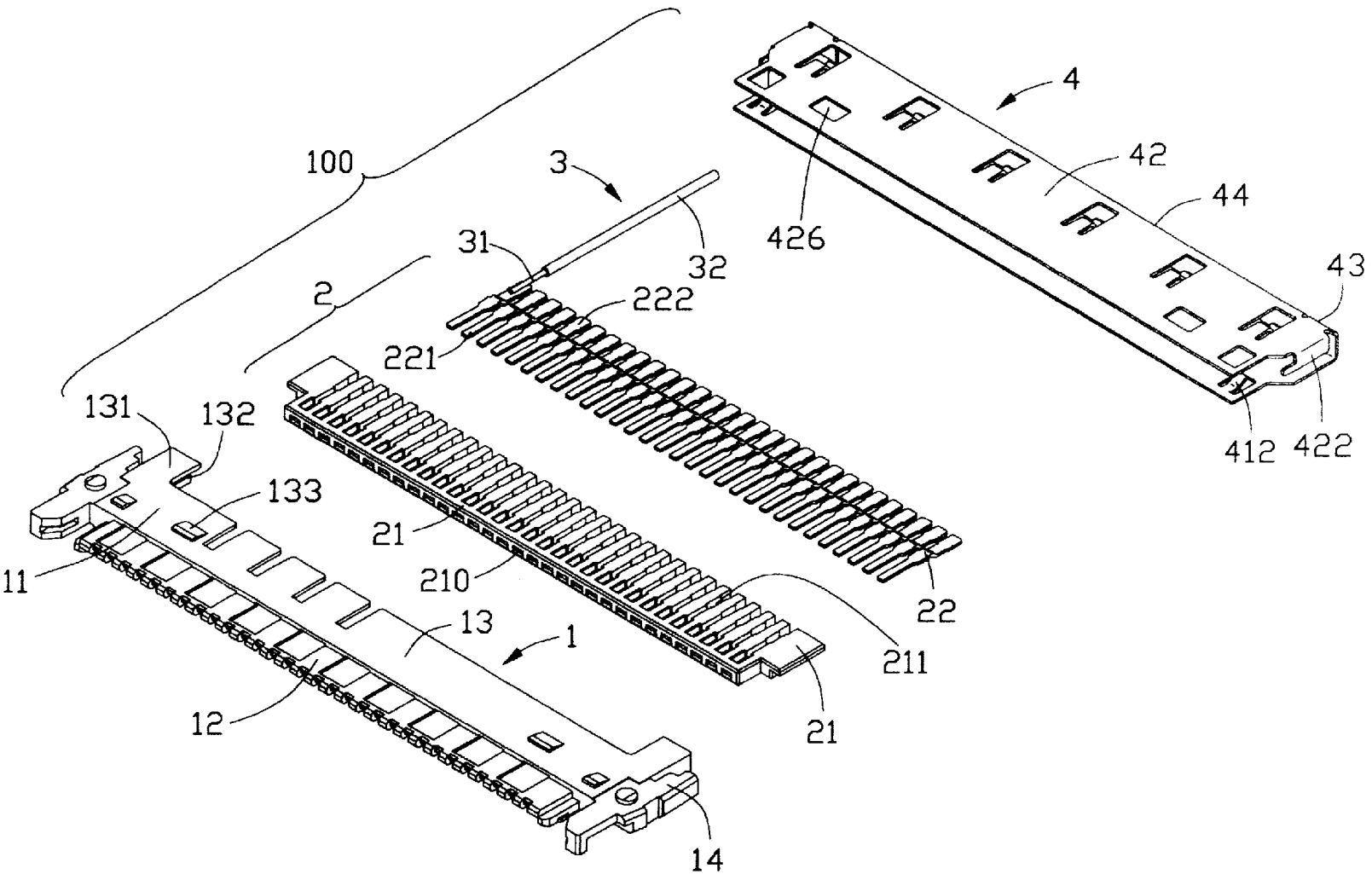
FIG. 1 is an exploded view of a micro coaxial cable connector in accordance with the present invention.
Figure 2:
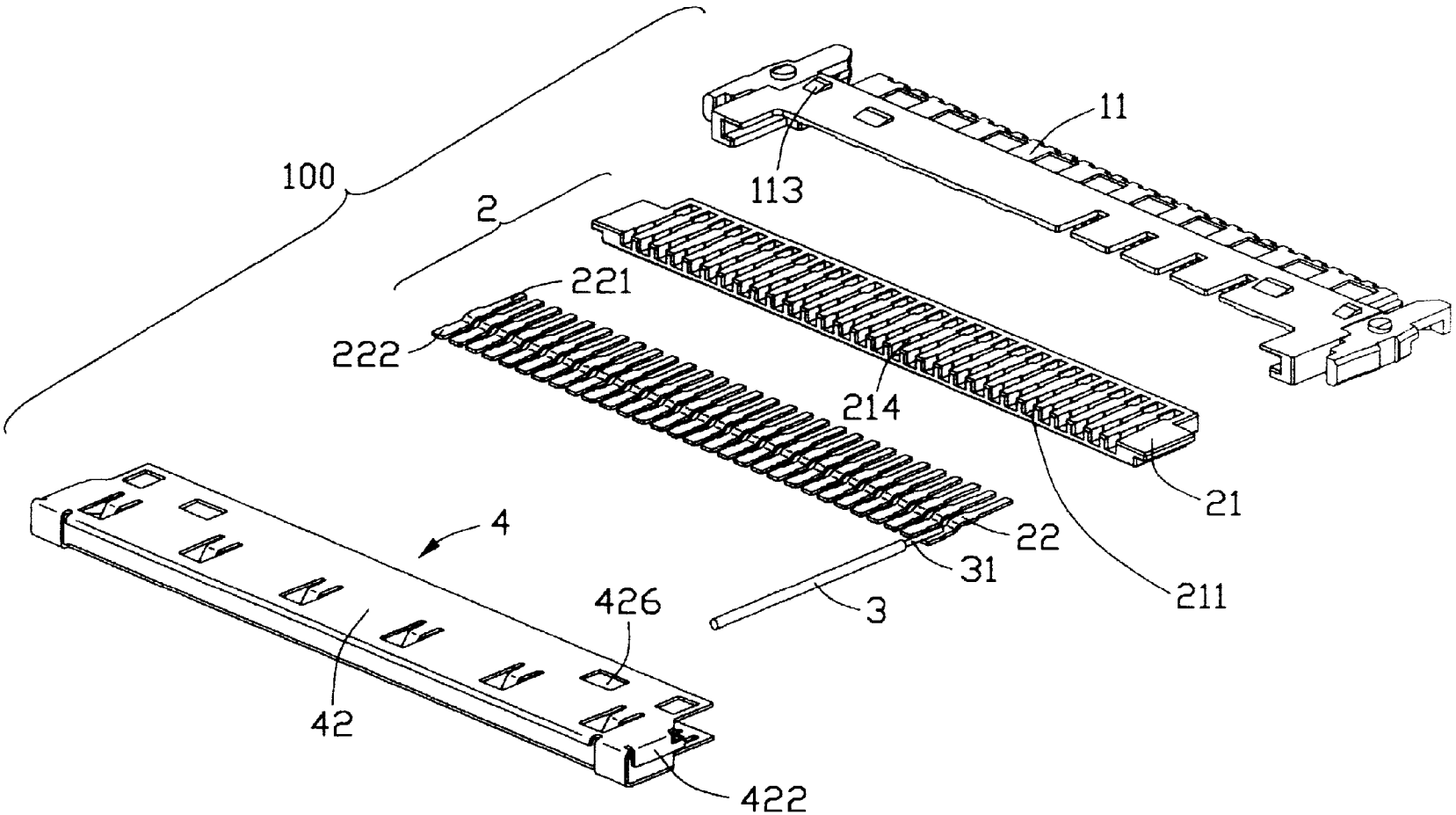
FIG. 2 is a view similar to FIG. 1, from a different aspect.
Figure 3:
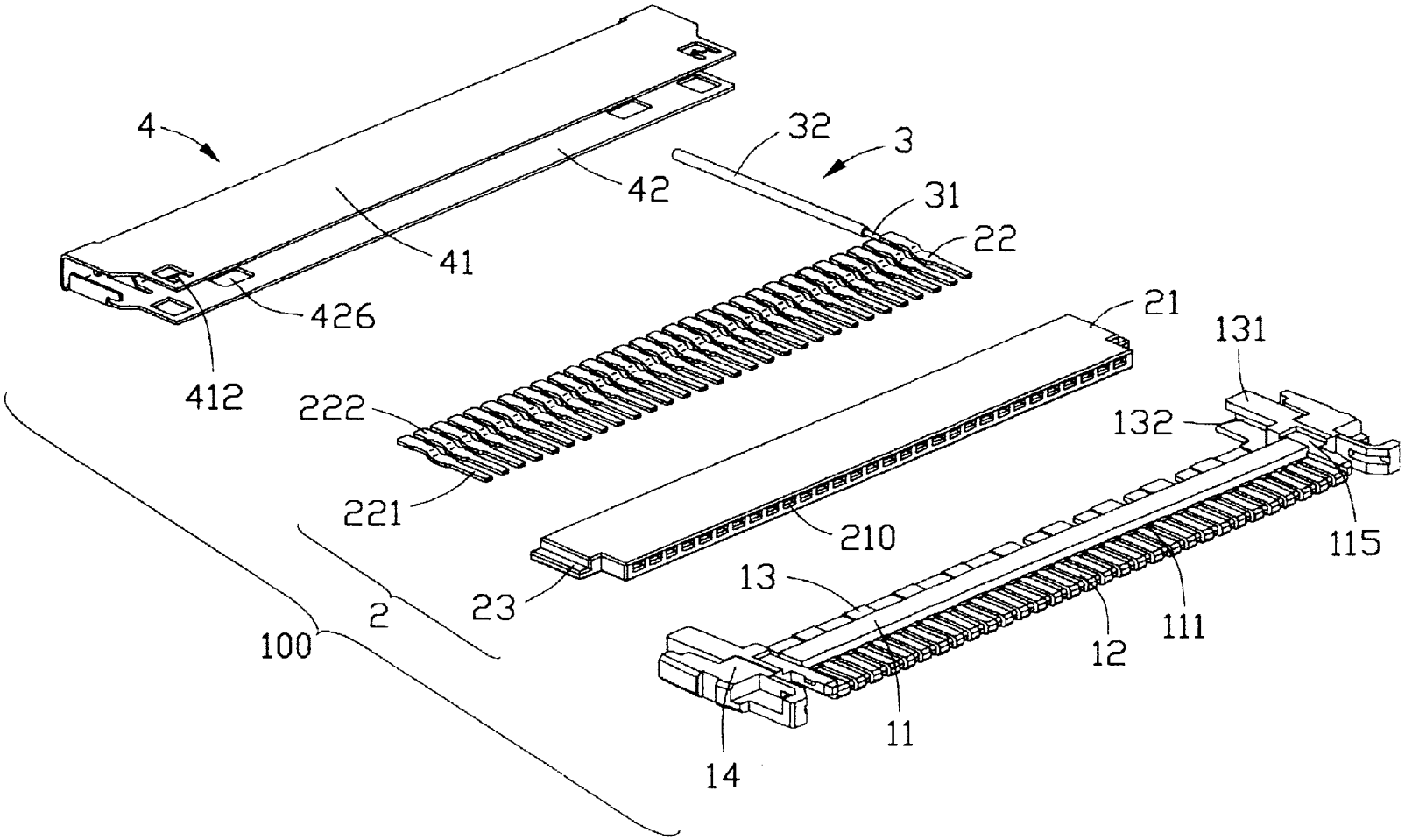
FIG. 3 is a view similar to FIG. 1, from a further different aspect.

Referring to FIGS. 1–3, a low profile micro coaxial cable connector 100 of the present invention comprises an insulative housing 1, a contact set 2, a plurality of wires 3 (only one shown), and a shield 4 made of metal.

The insulative housing 1 comprises an elongate base portion 11, a tongue portion 12 extending forwardly from the base portion 11, a rear portion 13 at a rear end of the base portion 11, and a pair of mounting portions 14 formed on lateral ends of the base portion 11. A pair of recesses 115 is defined in an upper surface of base portion 11. The base portion 11 and the tongue portion 12 together define a plurality of passageways 111 from the rear end of the base portion 11 to a front end of the tongue portion 12. A pair of receiving sections 131 is formed on lateral ends of the rear portion 13. Each of the receiving sections 131 defines a receiving hole 132 in an inner side thereof. A plurality of blocks 133 is formed on a bottom face of the base portion 11.

The contact set 2 comprises an insulative insert 21, and a plurality of contacts 22.

The insulative insert 21 defines a plurality of passageways 210 in a front end thereof. The insulative insert 21 further defines a plurality of channels 211 communicating with the corresponding passageways 210. Each channel 211 includes a soldering portion 2111, an obstructing portion 2112 in rear of the soldering portion 2111, and a retention portion 2113 in rear of the obstructing portion 2112. A plurality of partitions 215 is formed at a bottom side of the insulative insert 21. Each of the channels 211 is defined between two neighboring partitions 215. Each partition 215 is formed with a pair of lateral protrusions 216 at opposite lateral sides thereof. The obstructing portion 2112 of each channel 211 is defined by two neighboring lateral protrusions 216. The obstructing portion 2112 is narrower than the retention portion 2113 and the soldering portion 2111. A pair of projections 23 is integrally formed at a pair of opposite lateral sides of the insulative insert 21.

Figure 4:
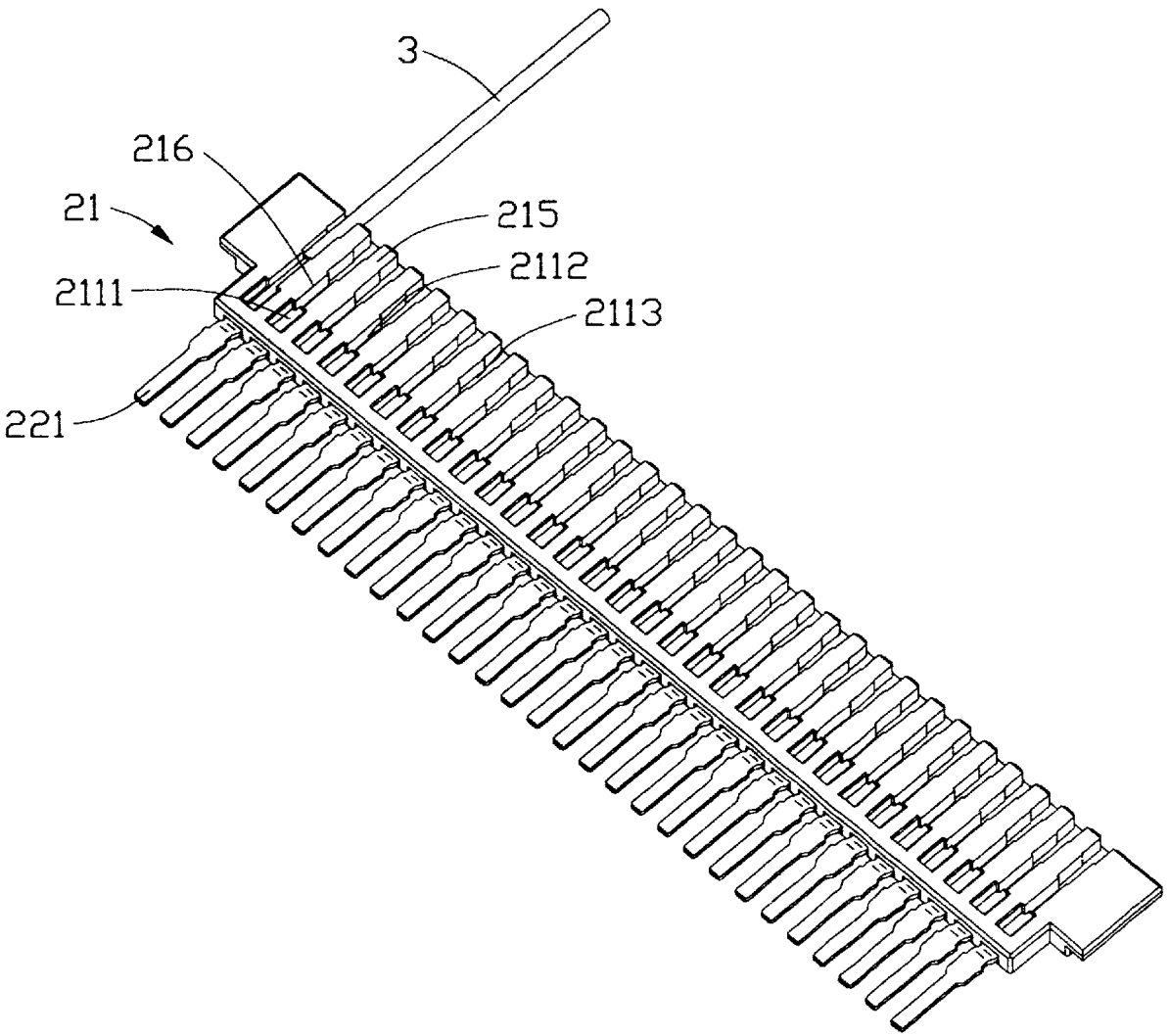
FIG. 4 is an assembled view of an insulative insert, a plurality of wires and a plurality of contacts of the cable connector.
Figure 5:
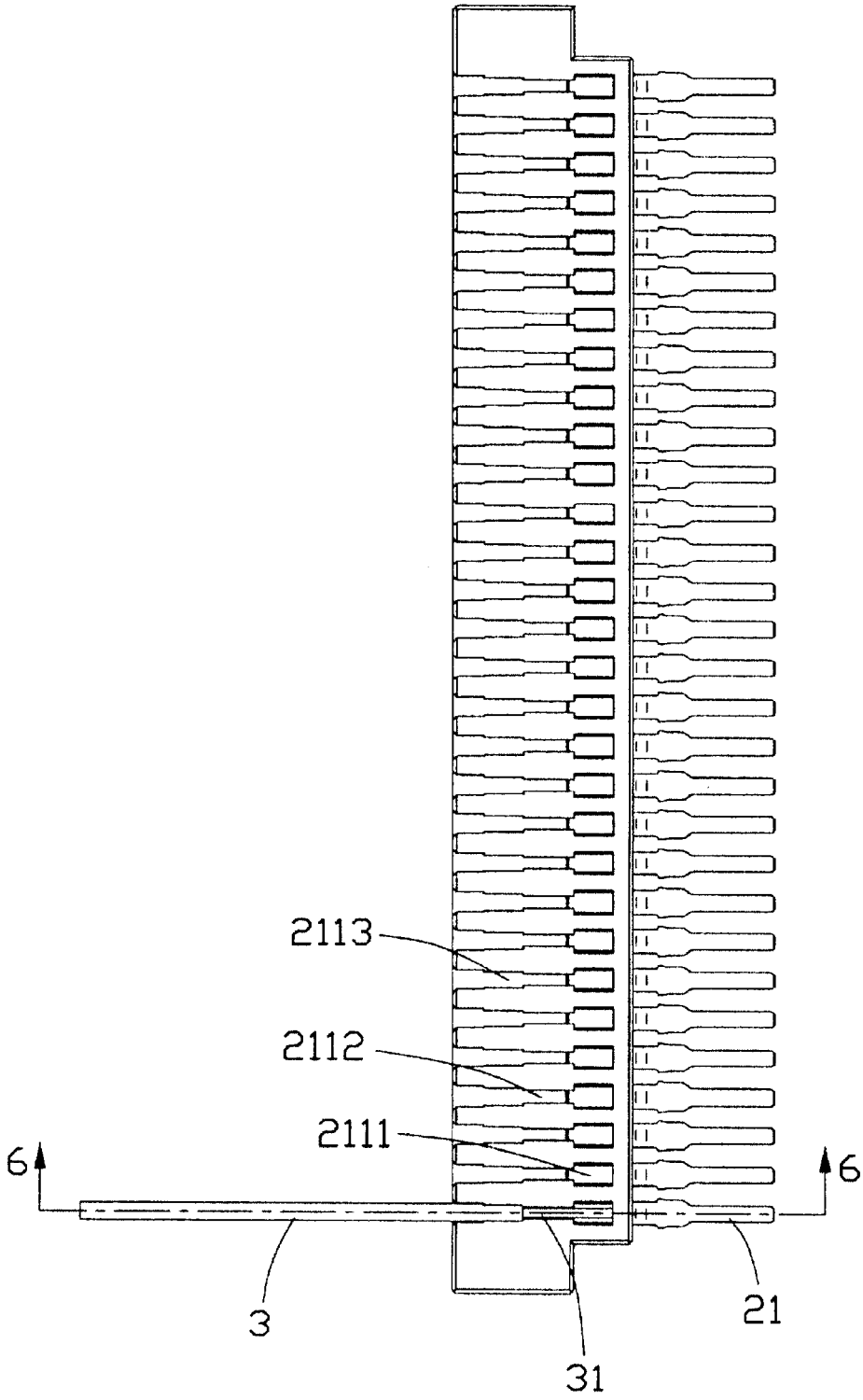
FIG. 5 is a top view of FIG. 4.
Figure 6:
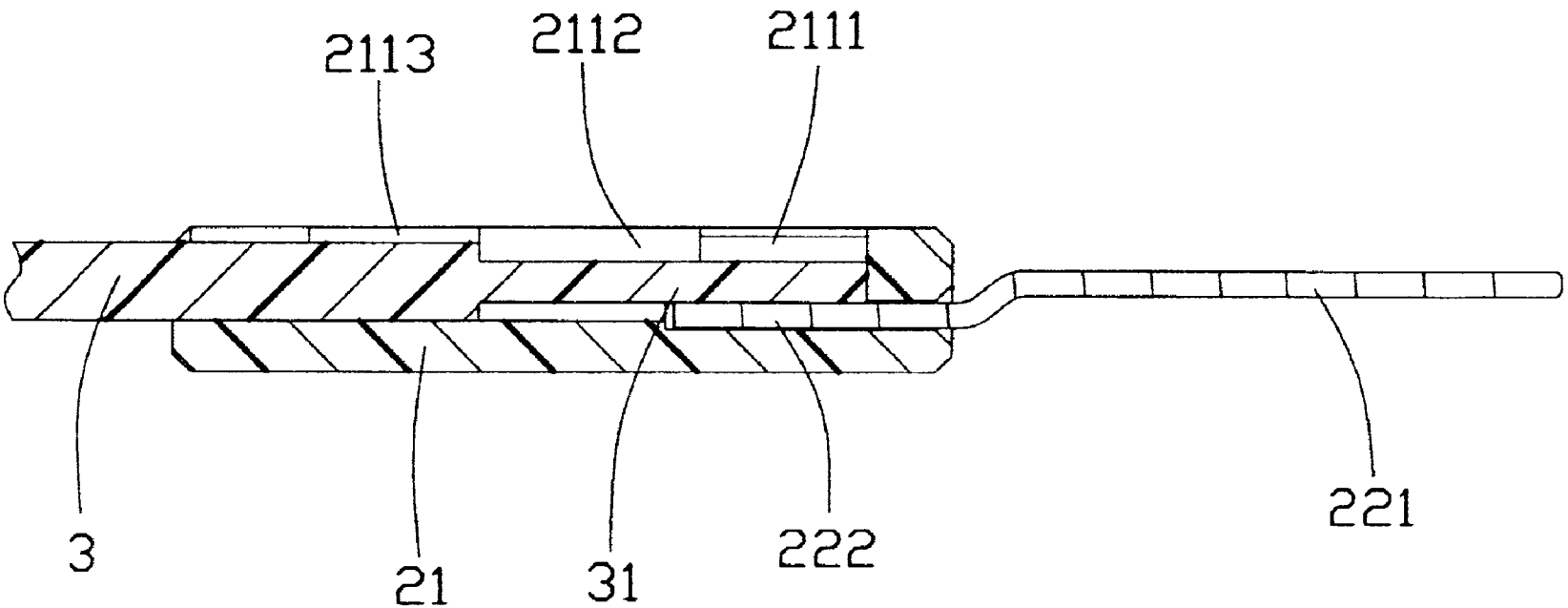
FIG. 6 is a cross-sectional view taken along line 6—6 of FIG. 5.

Referring to FIGS. 4–6, each contact 22 comprises an engaging portion 221 inserted along a rear-to-front direction through a corresponding channel 211 and passageway 210 of the insulative insert 21 to be located beyond a front face of the insert 21, and a connecting portion 222 received in the soldering portion 2111 of the channel 211. Each connecting portion 222 is soldered with a conductor 31 of a corresponding wire 3 which has a PVC insulation 32 sheathing the conductor 31.

The conductor 31 of each wire 3 has a front end exposed to outside (i.e., not covered by the PVC insulation 32). The exposed front end of the conductor 31 is used for soldering to the connection portion 222 of a corresponding contact 22.

Referring to FIGS. 1, 2 and 3, the shield 4 comprises an upper plate 41, a lower plate 42, and a pair of connecting portions 43 connecting rear portions of the upper plate 41 and the lower plate 42. A receiving space 44 is defined between the upper and the lower plates 41 and 42. A pair of side portions 422 extends from a pair of lateral ends of the lower plate 42 to the upper plate 41. A plurality of apertures 426 is defined in the lower plate 42. A pair of resilient bars 412 extends from the upper plate 41 into the receiving space 44.

Referring to FIGS. 1–6, in assembly, the contacts 22 are first inserted into the channels 210 of the insulative insert 21; the engaging portions 221 of the contacts 22 extend through the passageways 210 of the insulative insert 21 and the connecting portions 222 are received in the soldering portions 2111 of the channels 211. Thus, the contact set 2 is completed. Hereafter, particularly referring to FIG. 6, the wires 3 are assembled to the contact set 2 by positioning the exposed front ends of the conductors 31 into the obstructing portions 2112 and the soldering portions 2111 and the PVC insulations 32 into the retention portions 2113. Hot air is then blown into the soldering portions 2111 to melt solder therein thereby soldering the exposed front ends of the conductors 31 and the connecting portions 222 of the contacts 22 together. By the provision of the obstructing portions 2112, which are narrower than the soldering portions 2111 and the retention portions 2113, the hot air is prevented from flowing into the retention portions 2113 to melt the PVC insulations 32.

The contact set 2 together with the wires 3 is then assembled to the insulative housing 1. The projections 23 are received into the receiving holes 132 of the rear portion 13 of the insulative housing 1. The engaging portions 221 of the contacts 22 extend into the passageways 111 of the insulative housing 1, in which the contacts 22 have an interferential fit with the insulative housing 1.

The insulative housing 1 is then assembled into the receiving space 44 of the shield 4 with the plurality of blocks 133 fitted into the apertures 426, the resilient bars 412 engaging in the recesses 115 of the base portion 11 of the housing 1. Thus, the insulative housing 1, the contact insert 2, the wires 3 and the shield 4 are assembled together to form the cable connector 100 in accordance with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An cable connector assembly, comprising:

an elongate insulative housing having a base portion, a tongue portion extending from the base portion, and a plurality of passageways defined through the base portion and the tongue portion;

a contact set assembled to a rear end of the housing and comprising an insulative insert, the insulative insert including a plurality of channels, a plurality of contacts received in the channels, the contacts extending into the passageways of the housing;

a plurality of wires connected to the contacts and received in the channels of the insulative insert; wherein each of the channels of insulative insert comprises a soldering portion, an obstructing portion m rear of the soldering portion, and a retention portion in rear of the obstructing portion, the obstructing portion being narrower than the soldering portion and the retention portion, and wherein each of the wires has a conductor and an insulation sheathing the conductor, a front exposed end of the conductor being received in corresponding obstructing and soldering portions and soldered to a portion of a corresponding contact in the corresponding soldering portion, and the insulation being received in a corresponding retention portion; wherein the insulative insert forms integrally a plurality of partitions, the channels each being defined between two neighboring partitions, each partition being formed with two oppositely laterally extending protrusions, and wherein each of the obstructing portions is defined between two neighboring protrusions; wherein the base portion further includes a plurality of blocks thereon, further comprising a shield enclosing the housing and wherein the shield has a plurality of apertures engaging with the blocks of the base portion; wherein the insulative insert further forms a pair of projections on lateral ends thereof, a pair of receiving sections is formed on lateral ends of a rear portion of the insulative housing, and each of the receiving sections defines a receiving hole receiving a corresponding projection of the insulative insert.

2. The cable connector assembly as described in claim 1, wherein the contacts each comprise an engaging portion extending forwardly in a corresponding passageway of the housing, and a connecting portion received in the soldering portion of a corresponding channel of the insulative insert.

* * * * *